United States Patent [19]

Tonellato

[11] 4,012,004

[45] Mar. 15, 1977

[54] DEVICE FOR THE ACCUMULATION OF MATERIALS IN STRIPS

[76] Inventor: Sylvain Tonellato, 15, rue Pierre Desjardins, 78800 Houilles, France

[22] Filed: Jan. 16, 1976

[21] Appl. No.: 649,940

[30] Foreign Application Priority Data

Jan. 17, 1975 France ..... 75.01448

[52] U.S. Cl. ..... 242/55.19 R; 242/55

[51] Int. Cl.[2] ..... B65H 17/48

[58] Field of Search ..... 242/55, 55.18, 55.19 R, 242/55.19 A

[56] References Cited

UNITED STATES PATENTS

| | | | |
|---|---|---|---|
| 3,341,139 | 9/1967 | LaTour | 242/55.19 R X |
| 3,782,662 | 1/1974 | Miller | 242/55.19 R |
| 3,885,748 | 5/1975 | Costello | 242/55.19 R |

FOREIGN PATENTS OR APPLICATIONS

| | | | |
|---|---|---|---|
| 515,530 | 2/1955 | Italy | 242/55.19 R |

*Primary Examiner*—Edward J. McCarthy
*Attorney, Agent, or Firm*—Sughrue, Rothwell, Mion, Zinn & Macpeak

[57] ABSTRACT

Elongated strip material is accumulated within a limited accumulation space between two parallel vertical plates in multiple turns within and inner and outer cage, the two cages being substantially cylindrical and formed of horizontal rollers mounted for rotation on fixed pivots such that the strip material is accumulated in a single spiral coil comprising at least two turns with the outer spiral and the inner spiral each being in communication to the exterior of that space through pairs of gripping rollers characterized by the taking out of the inner turns achieved by forming a helicoidal floating turn, the two ends of which are nipped between two gripping rollers in side by side fashion.

5 Claims, 4 Drawing Figures

1a
25
4
26
5
27
4
10
4b
7
4a
16
18
24
6

1a
2
3
3
1b
27
8
1c
22
9
9
6
24
19
2

DEVICE FOR THE ACCUMULATION OF MATERIALS IN STRIPS

The present invention relates to a device for the accumulation of materials in strips, for example of sheet-metal, wherein the strip is wound in spiral form.

According to the invention, the said device comprises an external cage of horizontal-axis rollers 4 externally delimiting a first strip spiral 25, an internal cage of horizontal-axis rollers 5 internally delimiting a second strip spiral 26 connected to the first motor-driven gripping or nipping feed rollers 16 are disposed externally of the outer cage and between which the strip 24 passes prior to being wound to form the first spiral 25, and motor-driven-gripping or nipping extracting rollers 7 disposed within the cage of inner rollers 5 and between which the strip 24 travels on leaving the second spiral 26. The present invention relates to devices for the accumulation of elongate materials, i.e. materials the length of which is considerably greater than the cross section, notably strips, tapes, or section members. It is suitable for all materials, but more particularly for metallic materials in respect of which accumulation problems are frequently encountered, either due to velocity variations between two successive treatment stations, or when at least one of the stations operates in discontinuous manner and it is not desired to halt those stations which operate continuously, or on the appearance of an anomaly such as a rupture necessitating intervention at a fixed station (at zero or low velocity), whereas it is not desired to halt the other stations which operate continuously.

Thus, the quantity of material to be accumulated is substantially proportional to the relative velocities (or absolute velocities in the event of total stoppage at a station) and the maximum duration of the incident or of the intervention to be effected.

On "trains" for the treatment of strip material at high velocity it is not unusual to have to accumulate several hundreds of meters of material. In the following text (also in order to achieve simplification and by way of example), there will be limitation to the mention of strip material, although it is to be understood that the invention applies also to other forms of materials. An important feature is the minimum radius of curvature, admissible for preventing permanent deformation (attainment of the elastic limit) or surface deterioration (cracking at the stretched or tensioned side, closing at the compressed side), these phenomena being extremely troublesome in the processing of such surfaces. The person skilled in the art will know very well how to calculate or determine by experiment this minimum admissible radius of curvature.

Numerous devices are available on the market, which have the inconvenience of considerable bulk or high cost price.

Mention will first of all be made of a vertical accumulator comprising a well or shaft in which a strip descends freely. If the accumulator is required to have a capacity of 300 meters for example, the shaft must measure 150 meters and its width must be substantially greater than the minimum admissible diameter of curvature. This solution is simple but very costly and raises complicated problems if jamming or some other incident takes place in the accumulator.

It has been proposed to employ the same variable length strip solution, but by winding it between two cylindrical cages constituted by "families" of rollers, the end of the strip is displaced circularly between the two cages. This results in a device which is relatively bulky and complicated, since the two gages (roughly, the difference in radius of the cylindrical cages) must be greater than the minimum curvature diameter of the material. If winding is effected in a horizontal plane, there is considerable friction and notewortly ground bulk; if the winding is vertical, there is a risk that the upper portion of the windings along the outer cage may fall on those of the inner cage, thereby crushing the loop, which may be effected only with a small diameter of the external cage, above all if the material has only slight intrinsic stiffness (strips, for example). This leads to systems the external cage of which comprises a system for the positional regulation of all the rollers, so as to vary the cage diameter as a function of the materials to be accumulated. Furthermore, the travel-out of the material through the interior of the inner cage is necessarily effected by a helical loop the diameter of which must of course be greater than the minimum admissible diameter, this being difficult to achieve as soon as there is upstream traction, i.e. an outlet accumulating requirement greater than the supply at the inlet, whereby the loops are constricted, and attain or even exceed the admissible limits. With regard to this, mention will be made of French Pat. No. 2,149,866 (Wean), U.S. Pat. No. 3,628,742 (Armco) and British Pat. No. 1,220,025 (also Armco).

The present invention relates to an accumulator for strip material, wherein the strip forms a predetermined number of turns, thereby imparting considerable capacity thereto; however, the disadvantages of known spiral accumulators do not arise.

The accumulator according to the invention is characterised in that it comprises an external cage for horizontal-axis rollers, externally delimiting a first strip spiral, an internal horizontal-axis roller cage internally delimiting a second strip spiral connected to the first motor driven gripping or nipping feed rollers disposed externally of the outer cage and between which the strip travels prior to winding to form the first spiral, and driven gripping or nipping extraction rollers disposed internally of the inner roller cage and between which the strip passes on leaving the second spiral.

In a preferred embodiment of the invention, the gripper rollers for extraction have a length at least double the width of the strip and the latter travels twice between the said gripper rollers, forming a loop between its two passages; as a variant each of the said gripper rollers may be replaced by two separate rollers disposed in side-by-side relationship and each associated with one of the passes of the strip.

Means may be provided for driving, in rotation the lower rollers of the outer cage, in synchronism with the gripper feed rolls.

The strip leaves the accumulator according to the invention along a constant-dimension developable surface. Thus, there is no deformation of the strip. Furthermore, since the spirals formed by the strips are displaced whilst bearing on the rollers, there is practically no friction, thus making it possible to utilise the accumulator with wide, thick strips which, thus, are heavy. The minimum diameter is that of the developable helical loop which is regulated by the gripper rollers.

The acccumulator according to the invention necessitates only relatively low drive power. Relative to existing accumulators, it permits the achievement of an economy with regard to surface, costs and consumed energy. It may be employed in an already existing line, being for example disposed in a pit, in place of a wet pit or loop-type accumulator.

It will be pointed out already at this stage that the present accumulator is perfectly "reversible" and that if gripper rollers are provided at the inlet (or at the outlet) of the outer cage, the long gripper rollrs (or the double rollers) being provided at the inner loop side at the outlet (or inlet), the accumulator will be able to function in entirely reversible manner.

For a better understanding of the technical characteristics and advantages of the present invention, a description will be given of an example of embodiment thereof, it being understood that the said embodiment is not limitative with regard to the mode of carrying the same into effect or to the possible applications thereof.

As stated hereinabove, the reference will be to strip material, but the invention could be applied to section members, taking account of the minimum curvature diameter, generally larger, which section members require.

Reference will be made to the following figures.

Figure 2:
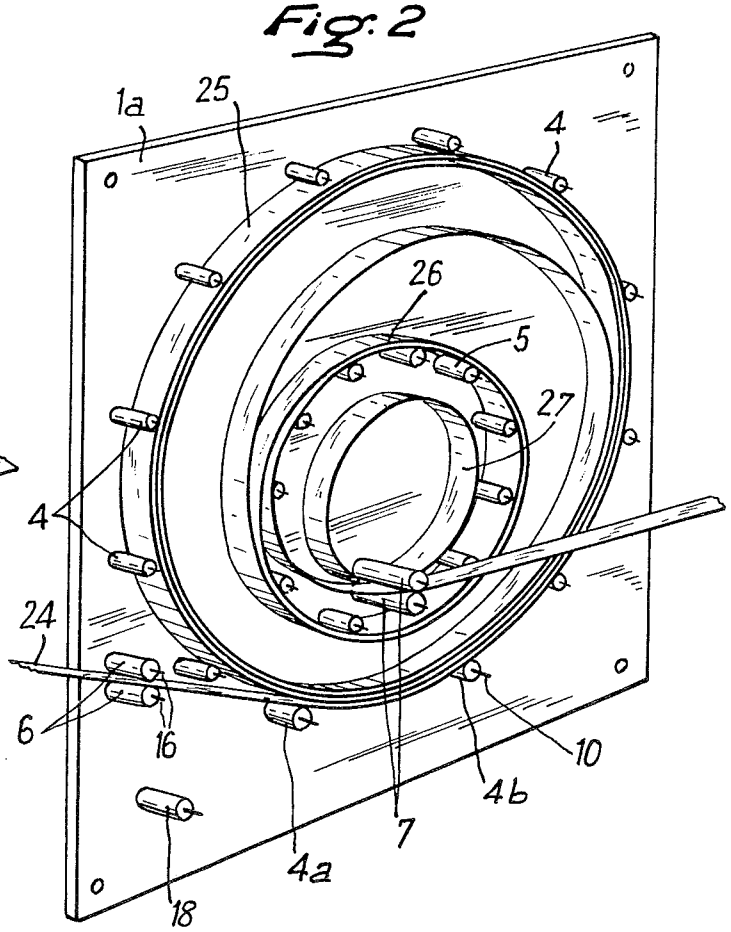
FIG. 2 is a diagrammatic perspective view showing the interior of the accumulator.
Figure 1:
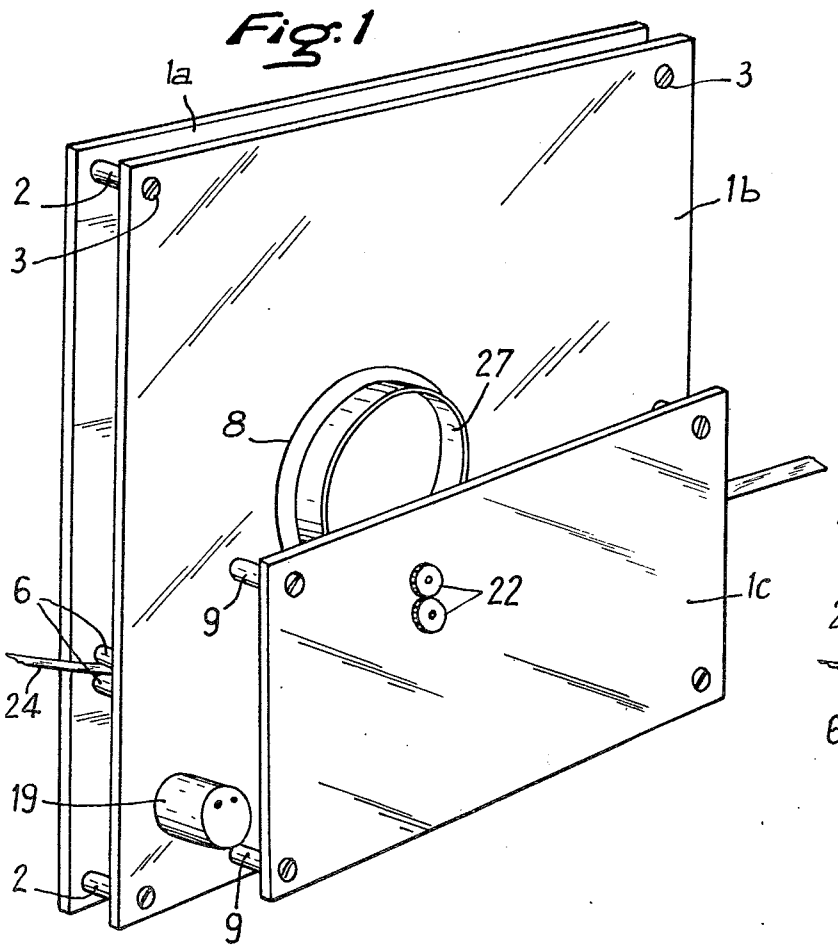
FIG. 1 is a diagrammatic perspective view of the accumulator.
Figure 3:
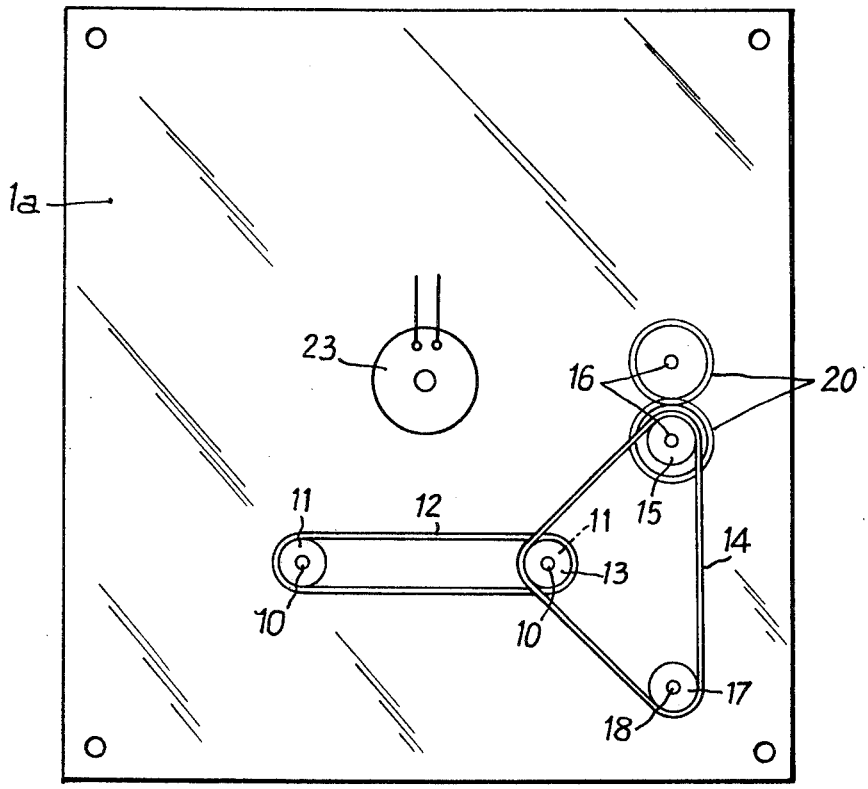
FIG. 3 is a rear view.
Figure 4:
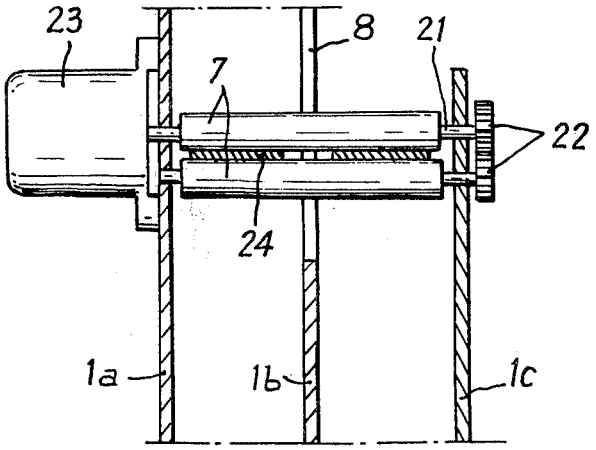
FIG. 4 is a view in vertical section at right angles to the inner gripper rollers.

As shown in the drawings, the accumulator device comprises two vertical support plates 1*a* and 1*b* or the like maintained spaced apart by cross-members 2 and secured to each other by screws 3. The distance between the said plates may be regulatable as a function of the width of material to be accumulated.

Interposed between the two plates 1*a* and 1*b* is two series of rollers 4 and 5 the axes or pivots of which are horizontal. Provided externally of the circle delimited by the rollers 4 are two gripper rollers 6. Provided within the circle delimited by the rollers 5 are two extraction gripper rollers 7. The rollers 7 are substantially twice as wide as the other rollers and extend through an aperture 8 formed in the plate 1*b*. The axes of the said rollers are supported by the plate 1*a* and by a third vertical plate 1*c* maintained spaced from the plate 1*b* by cross members 9.

The rollers 5 are idly mounted about their pivot axis. The same applies to the rollers 4, save with regard to the two lower rollers 4*a* and 4*b*. The pivots or axles 10 of the rollers 4*a* and 4*b* carry two chain pinions 11 connected to ech other by a chain 12; the pivot or axle of the roller 4a carries, furthermore, a second chain pinion 13. A chain 15 passes over the pinion 13, over a pinion 15 keyed on the output shaft 18 of the electric motor 19. The pivots or axles 16 of the two gripping rollers 6 carry further two toothed wheels 20 meshing with each other. Finally, the pivots or axles 21 of the two extraction gripper rollers 7 carry two toothed wheels 22 which interengage and one of these two pivots is connected to the shaft of an electric motor 23. Thus, it will be appreciated that the motor 19 permits the driving in synchronism of the two feed gripper rollers 6 and the two rollers 4*a* and 4*b*. On the other hand, the motor 23 permits the driving in synchronism of the two extraction gripper rollers 7. As already stated, all these movements may be reversed.

A sheet-metal strip 24 passes between the two gripper rollers 6, over the rollers 4*a* and 4*b* and over the various rollers 4, to be wound within these rolles and to form a spiral 25 which is driven in rotation by the rollers 4*a* and 4*b*, in synchronism with the the rollers 6. The inner turn of the said spiral then passes over the rollers 5, forming a second spiral 26. The inner turn of the said spiral passes between the gripper rollers 7 to form a helix 27 the pitch of which is is at least equal to the strip width, and then travels again between the gripper rollers 7, and leaves the machine.

When the extraction velocity of the rollers 7 is higher than that of the rollers 6, the number of turns of the spiral 26 is increased, whereas that of the spiral 25 is diminished. Conversely, when the velocity of the rollers 7 is lower than that of the rollers 6, the number of turns of the reel 26 is decreased, whereas that of the reel 25 is increased.

If the diameter of the circle internally tangent to the rollers 4 is designated D and the diameter of the circle externally tangent to the rollers 5 is designated *d*, and if *e* designates the thickness of the strip 24, and if it is assumed that the assembly of the reels 26 and 20 comprises only a single turn, then the value of the length difference constituting the apparatus capacity, and which is obtained when the said single turn passes from the spiral 25 to the spiral 26, is $$L = \pi\,(D - d - 2e)$$

In a general manner, if the assembly of the spirals 25 and 26 for n turns, the capacity of the device has for its value:

$$L = n\,\pi\,(L - d - 2ne)$$

When functioning, it is of course necessary that the average inlet and outlet velocities of the strip 24 should be the same. However, the strip 24 may have an instantaneous entry velocity V1 higher than the instantaneous exit velocity V2, the strip 24 entering during times T1 followed by stopping times T2. The following must obtain:

$$V2\ T2 < L$$

which determines the minimum number n of turns which the device must comprise.

The device is of course also utilisable when the entry velocity of the strip 24 is uniform and continuous, whereas its exit velocity is variable.

A calculation of the accumulation length has been given; this conditions, notably, the diameter of the outer cage and indicates the ground bulk and vertical dimension of the device. The bulk as to thickness is small, since it exceeds no more than twice the width of the widest material. Thus, one may be indicated to avoid excessively large diameters and to arrange in series a plurality of accumulators the smaller external diameter.

If, for example, two accumulators are arranged in series, several solutions may be envisaged:

1. the first is fed from the exterior, the inner outlet loop of the first directly feeds the second through the interior, extraction being effected externally; this makes it possible to couple the two accumulators with a common, vertical fixed plate and a plate on each side which may be mobile to permit introduction of variable width materials. It is useful that the velocity of the gripper rollers of the inner loop should be the mean of the velocities of the inlet and outlet gripper rollers, so as to accumulate the same quantity of material in the two accumulators. This is readily achieved with the aid of a differential.

2. Conversely, the two coupled or paired accumulators are fed, the first by an inner loop, a wide, external helical loop permitting passage from one to the other, the second involving extraction by a further inner loop.

3. The two accumulators may operate in the same manner, fed internally or externally, an intermediate, spiral loop providing for passage from the interior of one to the exterior of the other, or reciprocally. This makes it necessary to space the accumulators apart to permit passage between them of the connecting loop.

In the three cases, it is always possible to couple a larger number than two connected accumulators in accordance with the one or other of the solutions, providing for the various internal, external or intermediate connecting loops control or monitoring of the loop dimensions by long or multiple grippers, as stated with regard to the single accumulator. Furthermore, it is useful to distribute the accumulation uniformly between the accumulators, the loop velocities being in arithmetical progression between the entry and exit of the assembly.

I claim:

1. A device for the accumulation of elongated strip material of considerable length, said device comprising: an outer cage, an inner cage, said two cages being substantially cylindrical and comprising sets of horizontal rollers mounted for rotation on fixed pivots disposed substantially between two parallel vertical plates, said cages and said plates defining an accumulation space slightly wider than the width of said strip material in which the strip material is accumulated in a single spiral coil comprising at least two turns and forming outer and inner spirals, multiple pairs of gripper rollers for gripping respective strip material spirals to the inside and outside of said inner and outer sprials, respectively, and wherein the inner turn of the inner spiral is nipped at both its ends between at least one inner pair of said gripper rollers to form a helicoidal floating turn and one of said plates has an opening within the inner cage through which the inner pair of gripper rollers and one end of said helicoidal floating turn protrudes from said accumulation space.

2. The device according to claim 1, wherein the inner pair of gripper rollers have a length at least twice the width of the strip material, so as to simultaneously nip the two ends of the helicoidal floating turn with said ends positioned side by side.

3. The device according to claim 2, the inner pair of gripper rollers comprise means for simultaneously nipping the two ends of the helical turn and driving said two ends at the same velocity.

4. The device according to claim 1, further comprising means for driving the lower rollers of the outer cage at the same velocity as the outer pair of gripper rollers.

5. A process for the accumulation of a limited length of a travelling strip material during its travelling movement and wherein the strip length being accumulated may be different from the length of strip material leaving the area of accumulation, said method being characterised by the steps of forming a sprial of said strip material comprising a plurality of turns the diameters of whch may vary between the maximum diameter for an outer turn and a minimum diameter for the inner turn, commonly gripping both ends of the inner turn of the strip material leaving the spiral to form a helical trace, in such a manner that the axis of the downstream portion of the strip material is laterally offset from the axis of the upstream portion of the strip material relative to the inner turn by a distance greater than the strip width.

* * * * *